US005596897A

United States Patent [19]

Payne, Jr. et al.

[11] Patent Number: 5,596,897

[45] Date of Patent: Jan. 28, 1997

[54] MECHANISM FOR CONTROLLING FORM ROLL MOVEMENT IN SPIN FLOW NECKING MACHINE

[75] Inventors: Charles T. Payne, Jr.; Field I. Robertson, both of Chesterfield County, Va.

[73] Assignee: Reynolds Metals Company, Richmond, Va.

[21] Appl. No.: 527,250

[22] Filed: Sep. 12, 1995

[51] Int. Cl.[6] ..... B21D 19/12

[52] U.S. Cl. ..... 72/84; 72/110

[58] Field of Search ..... 72/84, 105, 106, 72/110

[56] References Cited

U.S. PATENT DOCUMENTS 5,228,321 7/1993 Shibasaka ..... 72/84

5,439,836 9/1994 Lee, Jr. ..... 72/84

*Primary Examiner*—Lowell A. Larson

*Attorney, Agent, or Firm*—Robert C. Lyne, Jr.

[57] ABSTRACT

A method and apparatus for spin flowing necking-in a D&I can is disclosed wherein an externally located free-spinning form roll is moved radially inward and axially against the outside wall of the open end of a trimmed can. A spring loaded interior support slide roll moves under the forming force of the form roll preferably through a cam control surface which controls the forming force acting thereon as the form roll advances radially inward as it slides along a sloped forming surface of a second free roll mounted axially inwardly adjacent the slide roll. To minimize the plug diameter variation between successively necked cans, the radially inward movement of the form roll is halted at a predetermined radial location via contact between the form roll support bracket with a form roll stop bracket. This prevents excessive form roll forces generated during radial inward advancing movement from acting against the second roll in a manner possibly causing undesirable radial movement thereof with correspondingly excessive plug diameter variation or wearing of coating material on interior necked-in can surfaces located between the form roll and the second roll.

13 Claims, 13 Drawing Sheets

MECHANISM FOR CONTROLLING FORM ROLL MOVEMENT IN SPIN FLOW NECKING MACHINE

TECHNICAL FIELD

The present invention relates generally to apparatus and methods for necking-in container bodies preferably in the form of a cylindrical one-piece metal can having an open end terminating in an outwardly directed peripheral flange merging with a circumferentially extending neck and, more particularly, to an improved spin flow necking process and apparatus for controlling the final movement of forming members to prevent unacceptable plug diameter variation.

BACKGROUND ART

Spin flow necking is a process of necking-in an open end of a metal container to ultimately provide a flange which allows a can end to be seamed thereto after filling. Necking also makes conveying of the cans easier since, with only slight flange overlap, the cans contact body-to-body instead of flange-to-flange which would otherwise cause tilting and conveying jams.

While numerous necking processes have been developed since the 1970's, a particularly promising spin flow process and apparatus having the potential of allowing can ends to be necked-in to increasingly smaller diameters is disclosed in U.S. Pat. No. 4,781,047, issued Nov. 1, 1988 to Bressan, which is assigned to Ball Corporation and is exclusively licensed to the assignee of the present invention, Reynolds Metals Company. The disclosure of this patent is hereby incorporated by reference herein in its entirety. It concerns a process where an externally located free spinning form roll 11 (FIG. 1) is moved inward and axially against the outside wall C' of the open end C' of a rotating trimmed can C to form a conical neck at the open end thereof. With further reference to FIG. 1, a spring-loaded holder or slide roll 19 supports the interior wall of the can C and moves axially under the forming force of the form roll 11. This is a single operation where the can C rotates and the form roll 11 rotates so that a smooth conical necked end is produced. In practice, the can is then flanged. The term "spin flow necking" is used in this application to refer to such processes and apparatus, the essential difference between spin flow necking and other types of spin necking being the axial movement of both the external roll 11 and the internal support 19.

More specifically, the exemplary spin flow tooling assembly 10 depicted in FIG. 1 (corresponding to FIG. 1 of the Bressan et al '047 patent, supra) includes a necking spindle shaft 16*a* rotatable about its axis of rotation A by means of a spindle gear 16 mounted to the shaft between front and rear bearings (not shown). The slide roll 19 is mounted to the front end of the necking spindle shaft 16*a* through a slide mechanism 28, keyed to the shaft, which permits co-rotation of the roll 19 while allowing it to be slid by the necking forces described more fully below in the axially rearward direction B' away from the eccentric freewheeling roll 24 located adjacent the front face of the slide roll. The axially fixed eccentric idler roll 24, having an axis of rotation B which is parallel to and rotatable about spindle axis A, is mounted via bearings 16*b* and 23 to an eccentrically formed front end of an eccentric roll support shaft 18. This shaft 18 extends through the necking spindle shaft 16*a*. The spindle shaft 16*a* is rotated by the spindle gear 16 without rotating the eccentric roll support shaft 18.

The outer form roll 11 is mounted radially outwardly adjacent the slide and eccentric rolls 19,24.

The container slide roll 19 is shaped with a conical leading edge 19*a* designed to first engage the open end C" of the container C to support same for rotation about spindle axis A under the driving action of the necking spindle gear 16 which may be driven by the same drive mechanism driving each base pad assembly 29 engaging the container bottom wall. Slide roll 19 is also free to slide axially but is resiliently biased into the container open end C" via springs 20 which may be of the compression type.

In operation, the container open end C" engages and is rotated by the slide roll 19. The eccentric roll 24 is then rotated into engagement with a part of the inside surface of the container side wall C' located inwardly adjacent the open end C". With reference to FIGS. 2A–2E, the external form roll 11 then begins to move radially inward into contact with the container side wall C' spanning the gap respectively formed between the conical faces 19*a*,24*e* of the slide and eccentric rolls 19,24. More specifically, the side wall C' of the spinning container body C is initially a straight cylindrical section of generally uniform diameter and thickness which may extend from a pre-neck (not shown) previously formed in the container side wall such as by static die necking. As the external form roll 11 engages the container side wall C', it commences to penetrate the gap between the fixed internal eccentric roll 24 and the axially movable slide roll 19, forming a truncated cone (FIG. 2B). The side wall of the cone increases in length as does the height of the cone as the external form roll chamfer 11*c* continues to squeeze or press the container metal along the complemental slope or truncated cone 24*e* of the eccentric roll 24 as depicted in FIG. 2C. The cone continues to be generated as the external form roll 11 advances radially inwardly (the slide roll 19 continues to retract axially as a result of direct pushing contact from roll 11 through the metal) until a reduced diameter 124 is achieved as depicted in FIGS. 2C and 2D. As the cone is being formed, the necked-in portion 124 or throat of the container C conforms to the shape of the forming portion of the form roll 11. The rim portions 123 of the neck which extend radially outwardly from the necked-in portion 124 are being formed by the complemental tapers 11*b*,19*a* of the form roll 11 and the slide roll 19 to complete the necked-in portion.

The above-described spin flow necking process, while producing a large diameter reduction in the open end of the container C (e.g., 0.350"), has various drawbacks when applied to two-piece aluminum can manufacture. One drawback, for example, is grooving of the neck at the initial point of contact between rolls 11,19 in FIG. 2B which occurs on the inside of the container as a result of the small radii on the form roll pushing past and against the small radii on the slide roll as the form roll moves radially inwardly and axially rearwardly during the necking process along the chamfer 24*e* of the eccentric roll. Due to the force of spring 20 urging the slide roll 19 toward the eccentric roll 24, the metal caught between these colliding radii (which are forcefully pressed together under spring bias), is grooved on both the inner and outer surfaces of the neck. On the inside surface, this grooving results in metal exposure (i.e., wearing away of the protective coating) which often allows the beverage to "eat through" the container side wall C'. It has also been discovered that such grooving often results in actual cutting of the metal as the form roll 11 is radially inwardly advanced from the position depicted in FIG. 2B to that of FIG. 2C.

As the form roll 11 moves into its radially inwardmost position depicted in FIG. 2E, the spring pressure acting against the slide roll 19 in the direction of the form roll disadvantageously results in pinching of the end of the flange-like portion 123 and undesirable thinning of the metal. In some cases, particularly when necking a can to smaller diameters (e.g., 204 or 202), the edge is sometimes thinned down to a knife edge.

To prevent both grooving of the container side wall and excessive thinning of the flange type edge during the aforementioned spin flow necking process, a cam ring is secured to the slide roll to present a cam follower surface which is contacted by the form roll during radial inward advancing movement of the latter at the on-set of the necking-in process. The cam follower surface and the conical surface of the form roll facing the cam follower surface are further arranged to produce the following motions:

In FIG. 3A, the form roll axis has moved radially inwardly closer to the container axis and has started to form the neck. The conical surface 24*e* on the eccentric roll 24 has forced the form roll 11 toward the open end C" of the container C. The form roll 11 has just touched the cam follower surface 104. The small radius 106 on the form roll 11 is very close to the small radius 108 on the slide roll 19' but does not pinch the metal between these two points. This is because the cam ring follower surface 104 is positioned so these radii 106, 108 may approach each other but stay separated by a distance slightly greater than the initial side wall thickness. This is presently understood to be a key feature in the elimination of metal exposure and neck cracks caused by excessive contact pressure between the two small radii 106,108 in the uncontrolled collision of the form roll 11 with the metal wrapped around the small radii 108 on the slide roll 19 in the prior spin flow necking process described hereinabove. In other words, since the form roll 11 contacts the cam follower surface 104 as the two radii 106,108 approach, such contact results in retraction or rearward axial sliding movement of the slide roll 19' which permits the two radii to move past each other.

In FIG. 3B, the form roll 11 has penetrated further between the eccentric roll 24 and the slide roll 19'. The small radius 106 on the form roll 11 is just passing the small radius 108 on the slide roll 19'. The rolls 11,19' do not pinch the metal but have moved closer. As mentioned above, the form roll 11 is forcing the slide roll 19' back by contact between the form roll and the cam ring 102 instead of contact at this point between the form roll and the slide roll as occurred in the aforesaid prior spin flow necking process.

In FIG. 3C, the form roll 11 has continued its penetration and the small radius 106 is past the small radius 108 on the slide roll 19' (point A). At this point, the conical surfaces 19*a*,11*b* on the slide roll and the form roll, respectively, are opposite and parallel each other. The slide roll 19' and cam ring 102 have been pushed to the left in FIG. 3C. The combination of the metal thickening as a result of being squeezed between the form roll 11 and the eccentric roll 24 as the metal wraps around the forming surface 11*a* of the form roll, and the shape of the left or trailing conical surface 11*b* on the form roll, has reduced the relative clearance between the form roll and the slide roll so that the form roll is now actually putting slight pressure on the metal.

In FIG. 3D, the form roll 11 has now penetrated further into the gap between the eccentric and slide rolls 24,19'. The form roll 11 is clearly clamping the metal between it and the slide roll 19' and, as a result, a gap 130 has opened up between the form roll surface 11*b* and the cam ring follower surface 104. The form roll 11 is now pushing the slide roll 19' directly in the axially rearward direction through its contact with the metal, and not through the cam ring 102. Since the small radii 106,108 between the form roll 11 and slide roll 19' have already "slipped" past each other without undesirable grooving of the metal therebetween, the direct interaction of the form roll in thinning and shaping the metal against the bias of the conical surface 19*a* on the slide roll is important to ensure proper necking and distribution of metal.

In FIG. 3E, the form roll 11 has now penetrated to its radially inwardmost position to complete the formation of the spin flow neck. During the entire forming process, between 20 to 24 revolutions of the container C are required, depending on the diameter, thickness and the amount of diameter reduction in the container end. The rolling contact between the form roll 11 and the slide roll 19' has thinned the edge of the flange slightly. Therefore, in accordance with a further feature of this invention, the form roll 11 now once again contacts the cam ring 102 to prevent further thinning of the flange area of the container C, i.e., gap 130 has closed.

The foregoing cam ring improvement to the spin flow necking process is disclosed in U.S. patent application Ser. No. 07/929,933, filed Aug. 14, 1992, by Harry W. Lee, Jr. et al, now U.S. Pat. No. 5,245,848, issued Sep. 21, 1993, patent which is assigned to Reynolds Metals Company, the assignee of the present application. The disclosure of this patent is hereby incorporated by reference herein in its entirety.

The cam ring advantageously eliminates the grooving and cut necks, as well as excessive thinning of the flange, that were prevalent before its introduction. However, the interaction of the outer form roll with the eccentric and slide rolls to achieve the final necked-in state depicted in either FIG. 2E (no cam ring) or FIG. 3E (with cam ring) has been discovered, through extensive experimentation, to directly affect the plug diameter (i.e., the inner diameter of the necked-in portion such as measured at 124 in FIG. 2E) and the length of flange 123, with or without the cam ring, and at any given base pad setting (i.e., the fixed distance during necking between the base pad 29 supporting the can bottom and the axially immovable eccentric roll), resulting in unacceptable variations therein. In a can plant environment, particularly when employing numerous necking-in tooling assemblies in a multi-station machine of the type disclosed in U.S. patent application Ser. No. 07/929,932, filed Aug. 14, 1992, by Harry W. Lee, Jr. et al, entitled "Spin Flow Necking Apparatus and Method of Handling Cans Therein", now U.S. Pat. No. 5,282,375, issued Feb. 1, 1994, also assigned to Reynolds Metals Company, the present assignee, control over the plug diameter and flange width achieved with the tooling assembly at each station is critical to achieving homogeneity in product and successful continuous operation. The disclosure of the '375 patent is hereby incorporated by reference herein in its entirety.

To obtain acceptable plug diameter variations, U.S. patent application Ser. No. 07/953,421, filed Sep. 29, 1992, by Harry W. Lee, Jr. et al, now U.S. Pat. No. 5,349,836, issued Sep. 27, 1994, also assigned to Reynolds Metals Company, discloses spin flow necking tooling assembly 1000 in FIG. 4 wherein a plurality of identical stop spacers 1025 are bolted to the front end of the spindle mounting assembly with bolts 1044 located radially outwardly from the path of movement of the slide roll 19. The spacers 1025 extend radially inward from mounting screws 1044 to define a series of equi-spaced stop surfaces 1050 which are co-planar to each other and intersect the plane of axial movement of the rear facing shoulder 1052 of the slide roll 19.

An exemplary embodiment of such a machine is depicted in FIG. 1A of the U.S. Pat. No. 5,282,375, (hereinafter "the '375 patent"), incorporated herein by reference. Except as noted hereinbelow, the tooling assembly 1000 of FIG. 4A functions in a manner identical to the tooling assembly of FIG. 5 (incorporated herein by reference) disclosed in the '375 patent. Briefly, the eccentric roll 24 is rotated from its eccentric solid line position depicted in FIG. 4A in supporting contact with the can open end into a radially inward clearance position (not shown) via rotation of the pinion 108 through a plurality of tooling activation assemblies 200 mounted to the rear face of the tooling disc turret. FIG. 5 herein corresponds to FIG. 7 (the written disclosure of which is incorporated by reference herein) of '375 patent. Therein, it can be seen that rotation of pinion 108 as well as radial movement of form roll 11 (supported by shaft 1010) is controlled through a series of radially extending linkage arrangements 210 respectively interconnecting each tooling activation assembly 200 to a cam follower 204 in rolling contact with a cam surface 206 of a cam ring which is stationarily mounted to a support frame supporting the tooling disc turret. Further relevant details of FIG. 5 will be discussed hereinbelow.

With the stop spacers 1025 of FIG. 4A, as the form roll 11 is moved towards its radially innermost position of FIG. 3E under the action of cam follower 204 of FIG. 5 which rotates shaft 1010 through activation plate 275, the rear surface 1052 of the slide roll 19' contacts the stop surface 1050 of spacers 1025 which prevents further axial retraction of the slide roll assembly. This was expected to prevent or "freeze" final radial movement of form roll 11 which would otherwise occur solely as a result of contact between cam follower 204 with cam surface 206. In this manner, the final radial positioning of outer form roll 11 was intended to be controlled by the contact between the slide roll 19' with the spacers 1025 which axially "locks" the slide roll to override final radially inward camming movement of the outer form roll 11. Therefore, since the final radially inwardmost location of forming surface 11*a* of form roll 11 is now controlled by the stop spacer arrangement 1025 described supra, the resulting plug diameter formed by this surface 11*a* tended to be more uniform. Stated differently, as the form roll 11 is forced into the gap between the eccentric roll 24 and the slide roll 19, the slide roll is forced away from the eccentric roll as discussed in connection with FIGS. 3A–3D. When the slide roll assembly 19 hits the stop spacers 1025, movement of the slide roll is halted. This in turn stops further inward radial travel of form roll 11. The eccentric roll 24 is axially rigid so when the slide roll 19 hits the stop surface 1050, the gap cannot get any wider. Therefore, the form roll 11 must stop.

Although it is theoretically possible to stop the movement of the slide roll 19 in the necking tooling of the FIG. 1 embodiment (no cam ring) by placement of a spacer attached to collar 21 to contact the rear shoulder of slide roll 19', this is very difficult in practice. This is because when the form roll 11 forces the slide roll 19' against the stop surface 1025 in FIG. 4A, the force of the form roll that is moving the slide roll toward the stop acts through the cam ring and not through the can flange itself which would otherwise occur without the cam ring. The force required to actually form the can is approximately 80–100 pounds and the override spring 279 (FIG. 5) located on the side of the necking turret is pre-loaded to about 200–250 pounds. Since the cam follower movement transmitted through this spring 279 from cam follower 204 (FIG. 5) to the form roll 11 is a part of the mechanism which controls radial movement of the form roll, when the slide roll stops the form roll, it overrides this spring and the force of the form roll therefore builds from 80–100 pounds up to 200–250 pounds. This extra force must be supported by the cam ring on one side of the form roll and the eccentric roll and the can neck on the other side of the form roll. Therefore, if the cam ring is not used, the force required to stop the form roll must come from the slide roll face through the can flange to the form roll as in FIG. 1. This force on such a narrow can flange would be enough to roll the flange to a thin knife edge which unacceptably causes split flanges and uneven flange width.

Although the spring pre-load force cannot act upon the can material between slide roll 19 and form roll 11 as a result of the cam ring 102, a force vector corresponding to the full pre-load spring force acts directly on the eccentric roll 24 and a necked-in portion of the can extending between the rolls 11,24 as depicted in FIG. 3E. Consequently, this full force spring pre-load tends to cause either grooving or wearing away of the protective coating on the interior surface of the can contacting the eccentric roll 24. This can disadvantageously allow the beverage to "eat through" the container side wall. In addition, since the eccentric roll 24 is cantilevered relative to slide roll 19 through a small sub-shaft, it is theorized that there is a tendency for the eccentric roll to be deflected radially inwardly. It is believed that this uncontrolled deflection creates considerable and undesirable variation in plug diameter of the can open end and flange width to a lesser degree, particularly within the lower range of dimensional variation as a result of the radially inward deflecting movement of the eccentric roll under the spring pre-load force.

It is accordingly an object of the present invention to prevent unacceptable variations in can plug diameter and flange width during the spin flow necking process.

Another object is to control the inner action of the outer form roll with the inner eccentric roll to ensure such uniformity in plug diameters and acceptable plug diameter variation.

Still another object is to control the inner action of the outer form roll with both the inner slide roll and inner eccentric roll to ensure the aforesaid uniformity and acceptable variation.

Yet another object is to prevent excessive force from being transmitted from the outer form roll to the inner eccentric roll through the can material so that the final radially inward advancing movement is directly controlled by controlling movement of the outer form roll.

Yet another object is to provide a control mechanism that may be installed in each tooling assembly so as to pre-set the final radially inward movement of the outer form roll either in the plant tool room or on the production floor after installation of the assemblies in a multi-station machine, to achieve the aforesaid uniformity in plug diameter.

Yet another object is to provide a plug diameter control mechanism which is simple in design, easy to install, and capable of rugged continuous operation without wear.

DISCLOSURE OF THE INVENTION

An apparatus for necking-in an open end of a container body comprises a first member and a second member mounted for engaging the open end of the container side wall along an inner surface thereof. Means is provided for rotating the container body and externally located means moves radially inward into deforming contact with an outside surface of the container side wall in a region thereof overlying an interface between the first and second members. Such contact between the externally located means with the side wall causes the contacted wall portion to move radially inwardly into a gap formed at the interface, caused by axial separation of the first and second members under the action of the radially inward advancing movement of the externally located means into the gap to thereby neck-in the side wall. In accordance with the present invention, means is provided for limiting radial inward movement of the externally located member to ensure substantially uniform plug diameters in the necked-in cans.

In the preferred embodiment, the radial inward movement of the externally located means is cam controlled and the means for limiting its final radially inwardmost location overrides the radial movement otherwise provided through the camming surface and associated cam movement transmitting members.

In the preferred embodiment, the first member is a slide roll engaging and supporting the inside of the container open end. The slide roll is mounted for driven rotary motion about, and axial movement along, the container axis. The slide roll is resiliently biased into the container open end. The second member is an axially fixed roll mounted in axially inwardly spaced relation to the slide roll for engagement with an inside surface of the container side wall. The second roll has a conical end surface which faces the open end of the container and the slide roll includes a conical end surface facing the conical end surface of the axially fixed roll in opposite inclination thereto. The externally located means is a form roll having a peripheral deforming nose positioned externally of the container side wall and mounted for free rotary and controlled radial movement towards and away from the container. The form roll is biased for axial movement along an axis parallel to the container axis. The form roll deforming nose preferentially includes first and second oppositely inclined conical surfaces which are respectively opposed to the conical surfaces on the second roll and slide roll.

The stop means preferably includes a form roll stop bracket which is fixedly mounted to a tooling spindle housing supporting the first and second rolls. The stop bracket includes a stop surface in radial alignment with a radially movable surface formed on a form roll support bracket. Without the form roll stop bracket, the radially inwardly movable form roll is normally free to move in a radially inward direction against the first and second rolls with the can material being necked interposed therebetween and with a predetermined pre-load spring force applying a cantilevered force against the second roll through the necked-in can material interposed therebetween. However, with the form roll stop bracket of the present invention, the stop surface contacts the form roll support bracket to prevent further radially inward advancement of the form roll before the cam and spring controlled outer form roll has otherwise completed its radially inward movement as a result of cam follower action. Stopping of the form roll in this unique manner prevents further radially inward advancing movement of the outer form roll which advantageously results in substantially uniform plug diameters in successively necked cans without excessive pre-load spring force damaging either internal or external surfaces of the necked-in can.

The stop means of the present invention is preferably used in combination with the cam ring improvement mounted to the slide roll radially outwardly adjacent therefrom.

A method of spin flow necking-in an open end of the cylindrical container body is also disclosed. The method comprises the steps of positioning inside the container body an axially fixed roll engageable with the inside surface of the container body. The axially fixed roll has a sloped end surface which faces the open end of the container body. A slide roll is also positioned inside the container body which fits the inside diameter of the open end to support same. The slide roll has an end which faces the sloped end surface of the axially fixed roll. The slide roll is supported for axial displacement away from the axially fixed roll. The slide roll end and the sloped end surface of the axially fixed roll define a gap therebetween. An outer form roll is positioned opposite the gap radially outwardly from the container body for axial displacement away from the axially fixed roll during contact with the sloped end of same. The form roll has a trailing end portion and a peripheral forming portion. As the container body spins, the form roll is advanced radially inward relative to the gap so that the trailing end portion presented by the roll and the sloped end surface of the axially fixed roll engage the container body between them while the trailing end portion of the form roll moves inwardly along the sloped end surface of the axially fixed roll to roll a neck into the container body. As the body continues to spin while the form roll moves inwardly, the slide roll is retracted axially until the roller has spun an outwardly extending portion on the end portion of the container body engaged between the slide roll and the container. In accordance with the method of the invention, the final radial movement of the form roll is limited by having a form roll support bracket contact a form roll stop bracket fixedly mounted to supporting tooling assembly. Such limiting contact prevents further radially inward advancing movement of the outer form roll by overriding the cam follower movement of the outer form roll as well as any pre-load spring force acting on the outer form roll through cam follower movement transmission members. This in turn controls the radially inward acting spring force otherwise exerted by the outer form roll against the axially fixed roll to produce substantially uniform plug diameters in the necked-in containers.

In accordance with a further feature of the invention, the axial retracting movement of the slide roll, prior to the form roll support bracket contacting the form roll stop bracket, is controlled by contact between a surface of the form roll with a cam follower surface. More specifically, the form roll has conical surfaces which are respectively engageable with the sloped end surface of the axially fixed roll and another sloped end surface on the slide roll. These form roll conical surfaces are smoothly connected with a curved forming surface extending therebetween and defined by a pair of small radii. The sloped end of the slide roll is also smoothly connected through another small radius to the axially extending surface thereof which is engageable with the inside surface of the container body. The cam follower surface operates to axially retract the slide roll as the small radius on the form roll approaches the small radius on the slide roll to thereby prevent pinching of the container side wall between these two small radii by allowing the radii to approach each other while maintaining separation therebetween by a distance slightly greater than the original thickness of the container side wall. Continued radially inward forming movement past a predetermined point at which the metal of the container side wall between the slide roll and the conical surface of the form roll has thickened will result in the form roll putting slight pressure directly on the metal. A gap opens between the form roll and cam follower surface so that the form roll is now pushing the slide roll directly through contact with the metal and not through contact with the cam follower surface. As the outermost end of the container side wall moves between the form roll and the slide roll, the form roll will once again contact the cam follower surface so that the rolling contact between the form roll and the slide roll does not excessively thin the edge of the open end. As this occurs, the form roll support bracket contacts the form roll stop bracket to control the degree of rolling force contact between the form roll and the axially fixed inner roll so that the form roll in turn does not excessively thin the can material therebetween.

In accordance with a unique feature of the preferred embodiment, the form roll stop bracket includes a cylindrical, flat disk shaped portion formed with a plurality of circumferentially spaced slots through which respectively pass a series of mounting bolts adapted to secure the stop bracket to the necking spindle. Lower ones of the mounting bolts are fitted with control spacers which are provided with predetermined clearance to hold the stop bracket in a fixed axial location. The top mounting bolt(s) can be tightened to non-rotatably clamp the stop bracket to the necking spindle. Loosening of this (single) top bolt advantageously allows the plurality of mounting bolts to then relatively slide through their respective slots as a result of rotation of the stop bracket. The stop surface formed on an axially extending half-moon shaped or semi-cylindrical raised portion of the stop bracket is machined or offset such that the radial location of the stop surface varies as a function of rotation of the bracket about the spindle axis. By providing graduated marks along the stop surface with an alignment reference mark on the outer surface of the spindle, a precise radial location may be 'dialed-in' to enable easy and repeatable setting of the plug diameter.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 5:
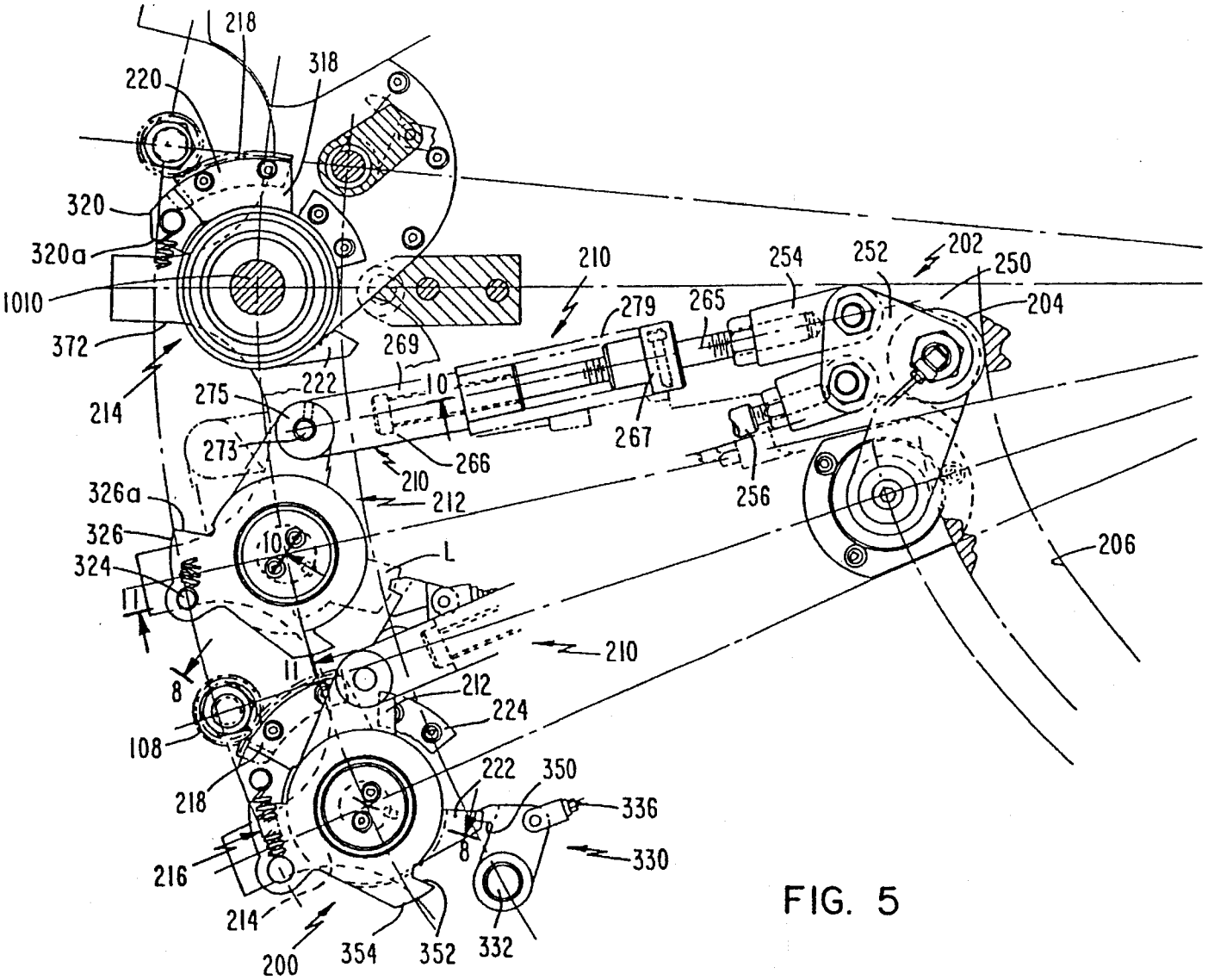
FIG. 5 corresponds to FIG. 7 of assignee's co-pending '932 application to depict cam controlled linkage and tool activation assemblies for controlling radial movement of the outer form rolls in a spin flow necking machine.
Figure 6:
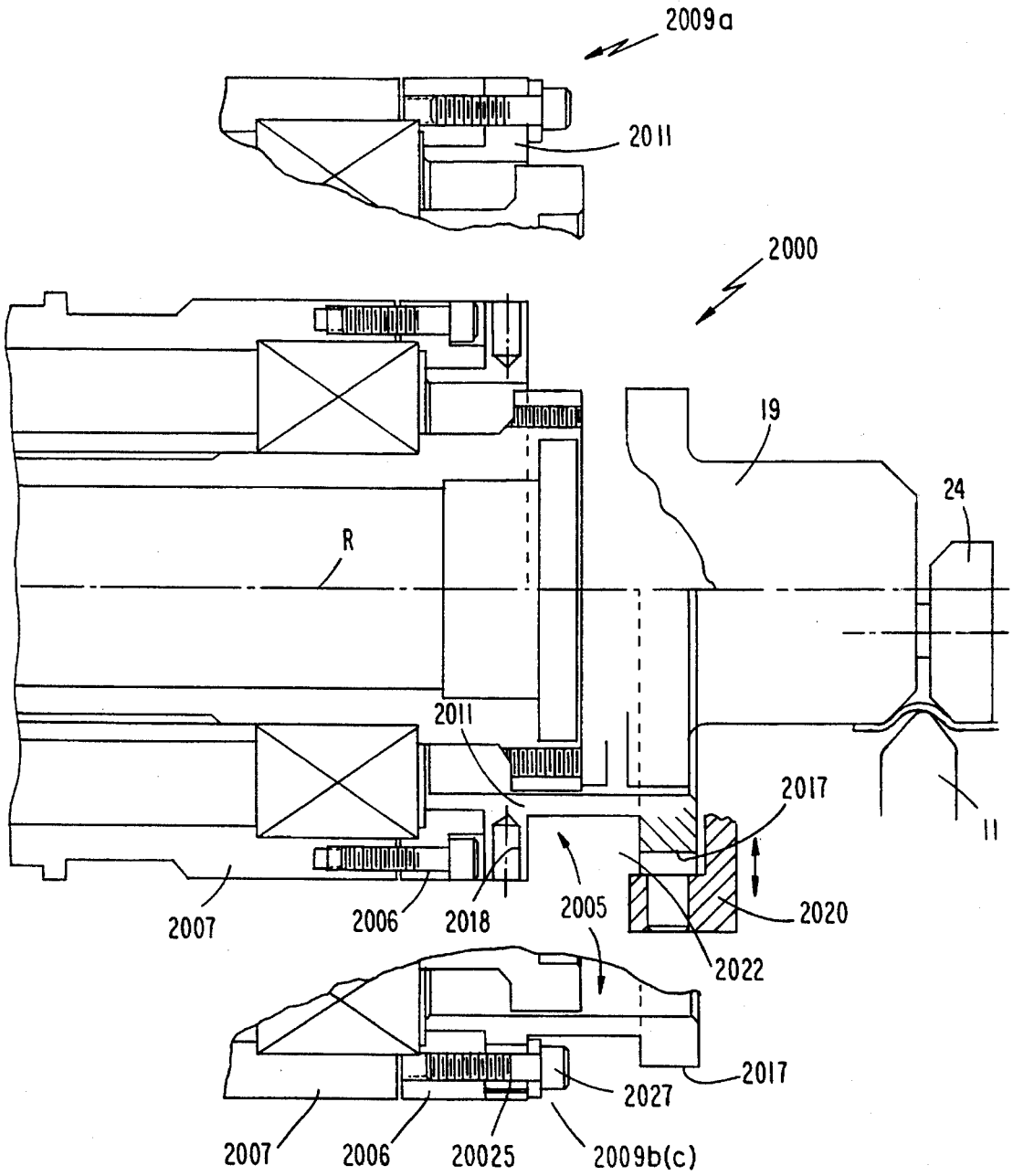
FIGS. 6 is a cross-sectional illustration of a form roll stop bracket in accordance with the present invention.

FIG. 6 is an illustration of a part of a spin flow necking assembly 2000 in accordance with the present invention. Therein, the functional components are substantially identical to the tooling components described in connection with FIGS. 1–5, supra, except as noted hereinbelow.

Figure 7:
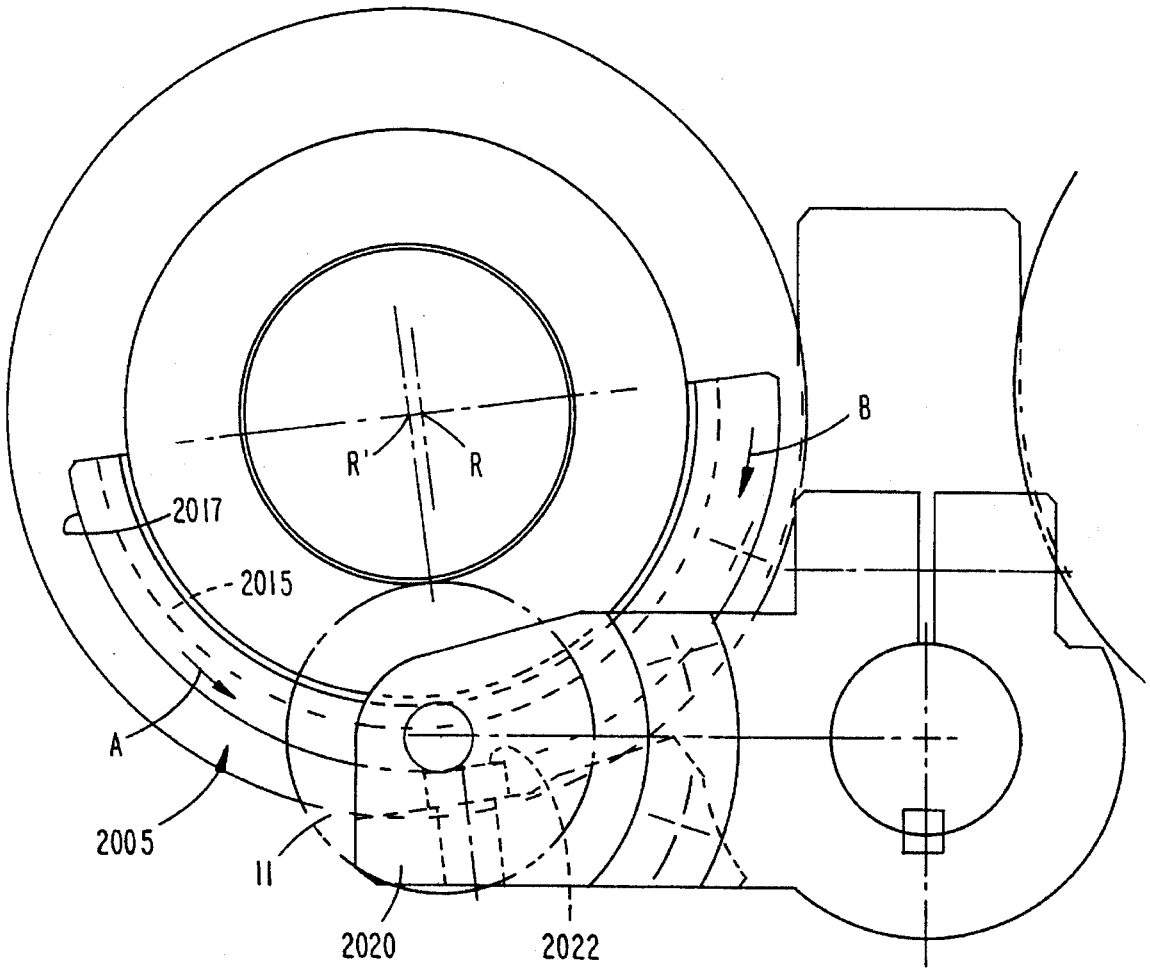
FIG. 7 is an end plan view of the form roll stop bracket and form roll support bracket of FIG. 6.

Furthermore, the spin flow necking assembly 2000 of FIG. 6 is adapted to be used as one of plural spin flow necking cartridges which may be mounted as known in the art to a main necking turret of a spin flow necking machine in respective co-axial alignment with base pad assemblies mounted to a base pad turret of such a machine. An exemplary embodiment of such a machine is depicted in FIG. 1A of the aforesaid co-pending application Ser. No. 07/929,932, incorporated herein by reference. Except as noted hereinbelow, the tooling assembly 2000 of FIG. 6 functions in the manner identical to the tooling assembly of FIGS. 4A and 5. Briefly, the eccentric roll 24 is rotated from its eccentric solid line position depicted in FIGS. 4A and 6 in supporting contact with the can open end into a radially inward clearance position (not shown) via rotation of the pinion 108 through a plurality of tooling activation assemblies 200 mounted to the rear face of the tooling disc turret. FIG. 5 herein corresponds to FIG. 7 (the written disclosure of which is incorporated by reference herein) of the co-pending '932 application. Therein, it can be seen that rotation of pinion 108 as well as radial movement of form roll or roller 11 (supported by shaft 1010) is controlled through a series of radially extending linkage arrangements 210 respectively interconnecting each tooling activation assembly 200 to a cam follower 204 in rolling contact with a cam surface 206 of a cam ring which is stationarily mounted to a support frame supporting the tooling disc turret. Further relevant details of FIG. 5 will be discussed hereinbelow.

Figure 1:
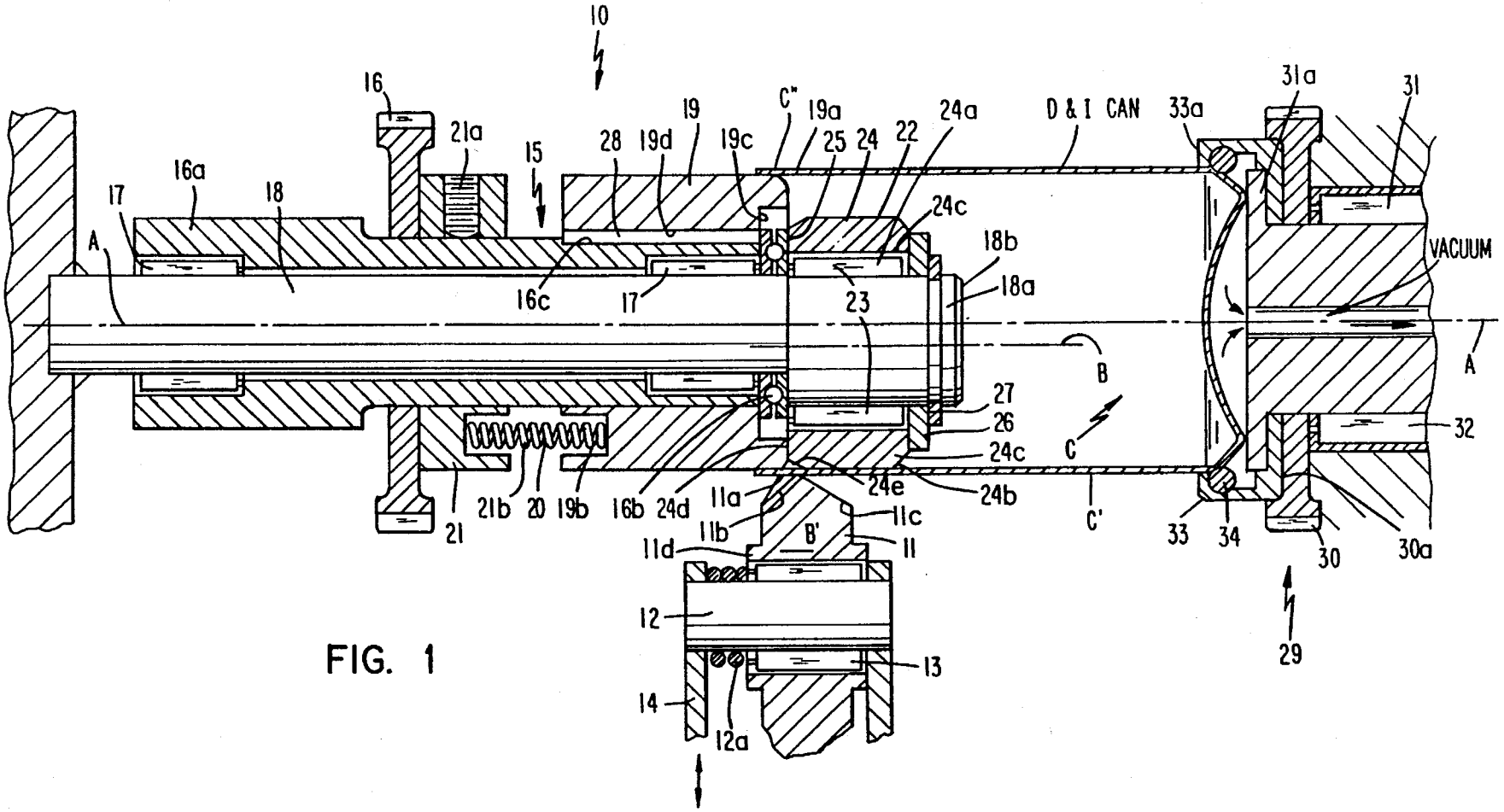
FIG. 1 is a cross-sectional view of a prior spin flow necking process.
Figure 2A:
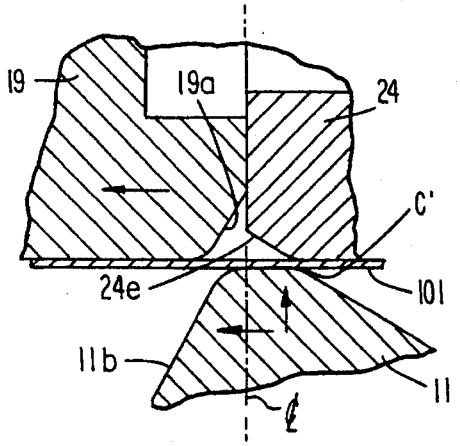
FIGS. 2A–2E are enlarged, cross-sectional sequential views depicting the spin flow necking forming sequence with the tooling of FIG. 1.
Figure 2B:
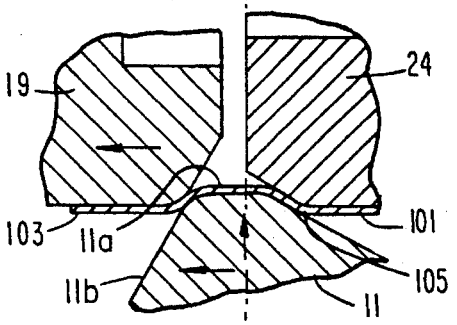
Figure 2C:
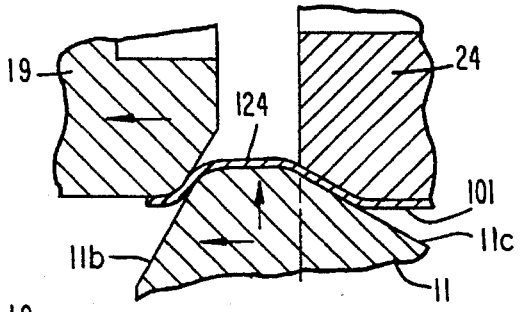
Figure 2D:
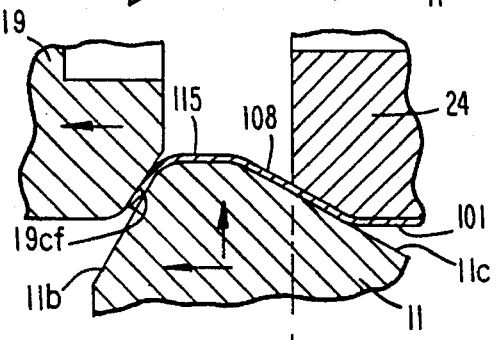
Figure 2E:
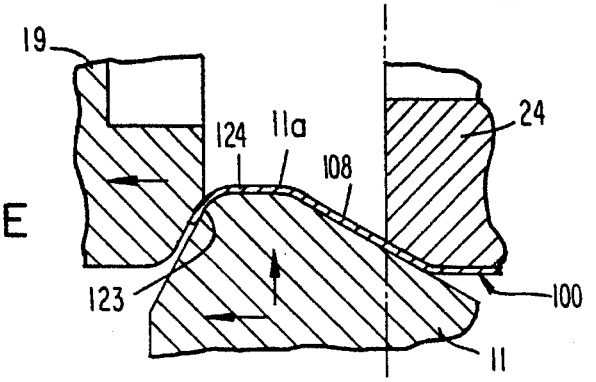
Figure 3A:
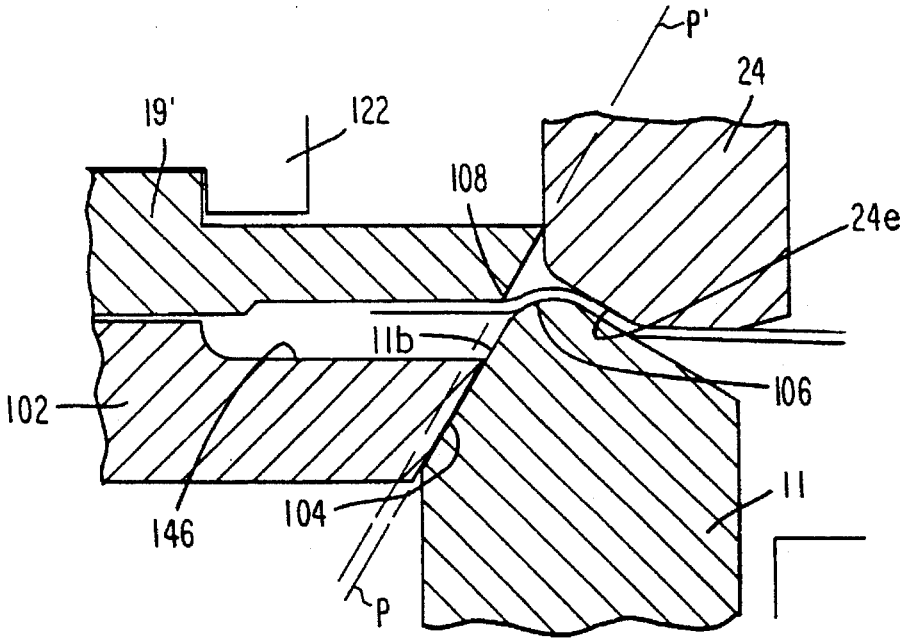
FIGS. 3A–3E are enlarged, detailed sequential views depicting the relative locations of the tooling components during necking with a prior cam ring improvement.
Figure 3B:
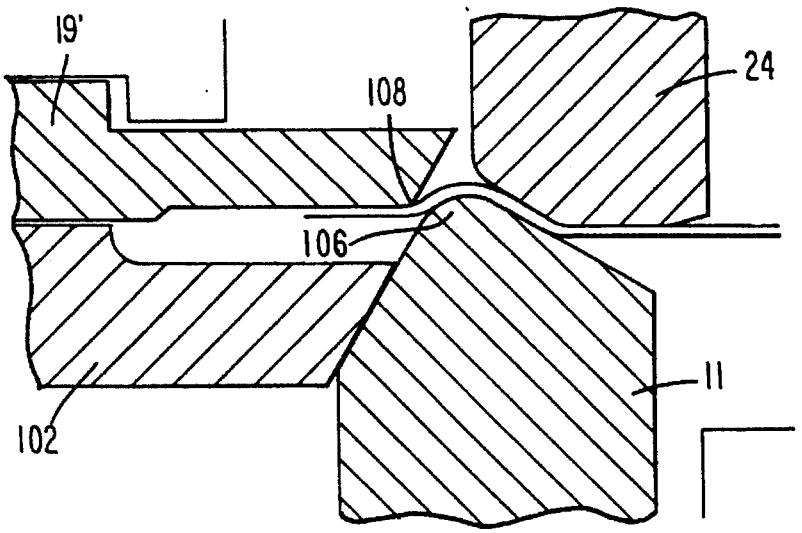
Figure 3C:
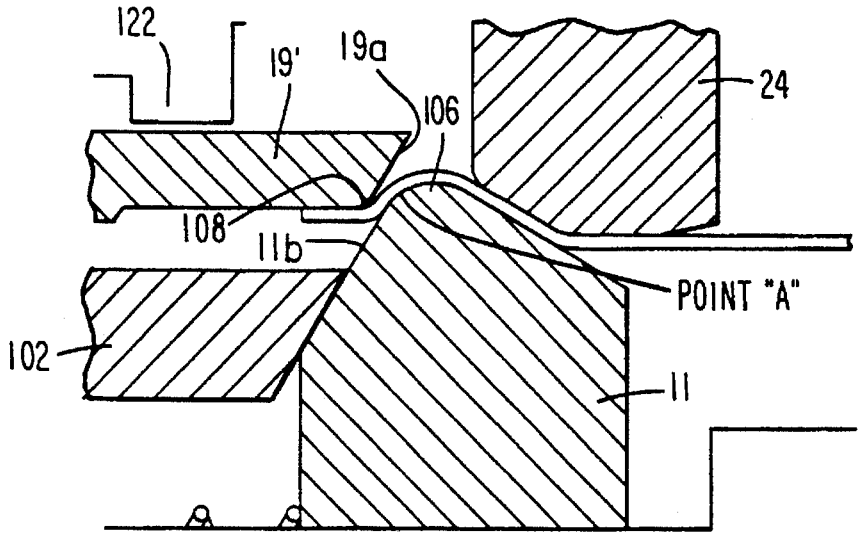
Figure 3D:
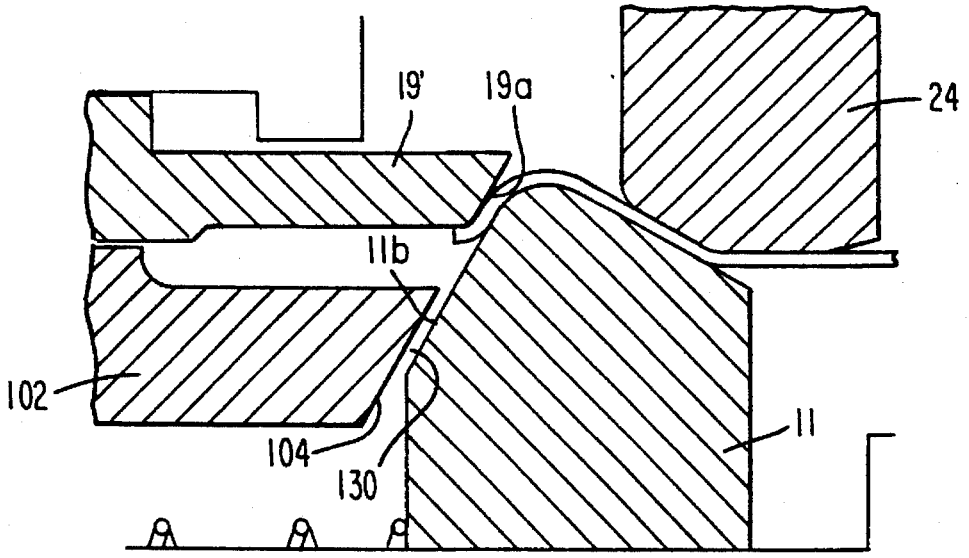
Figure 3E:
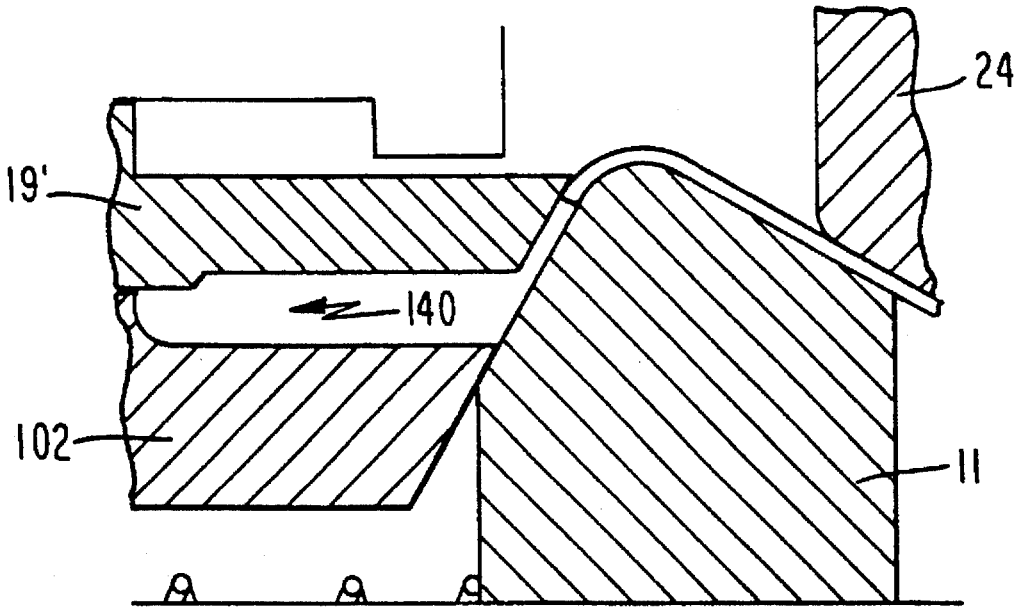

As discussed above, each necking spindle assembly 2000 depicted in FIG. 6 operates in substantially the same manner described supra with reference to FIGS. 3A–3E. However, in accordance with the present invention, the necking operation described in connection with FIG. 3E is effected through the interposition of a form roll stop bracket 2005 which is bolted with a plurality of bolts **2009*a*, 2009*b* and 2009*c* to an end plate 2006 attached to the front end of the spindle mounting assembly 2007. The form roll stop bracket 2005 includes a circular, flat disk shaped mounting section 2005 (best depicted in FIG. 8) formed with three circumferentially spaced arcuate through slots 2013 through which bolts 2009*a–c* respectively pass to mount the disk to the spindle assembly end plate 2006. A semi-cylindrical wall 2015 projecting axially rearwardly from the disk shaped mounted section 2005 terminates in a radially outwardly facing stop surface 2017 in radial alignment with a forwardly projecting portion of the form roll support bracket 2020 (FIGS. 6 and 7) to intersect the plane of radial movement of a corresponding stop surface 2022** in the form roll support bracket.

With the form roll stop bracket 2005 depicted in FIG. 6, as the form roll 11 is moved towards its radially innermost position of FIG. 3E under the action of cam follower 204 of FIG. 5 which rotates shaft 1010 through activation plate 275, the radially inward facing stop surface 2022 on the form roll support bracket 2020 contacts the stop surface 2017 on the form roll stop bracket 2005. This stopping action in turn prevents or "freezes" both final radial movement of, and any increase in force transmission to, form roll 11 which would otherwise occur solely as a result of contact between cam follower 204 with cam surface 206 under the full force pre-load spring 210 (i.e., 200–250 pounds). In this manner, the final radial positioning of outer form roll 11 is always controlled by the contact between the form roll support bracket 2020 with the form roll stop bracket 2005 which radially "locks" the form roll to override final radially inward camming movement of the outer form roll 11. Therefore, since the final radially inwardmost location of the forming surfaces of form roll 11 is now controlled by the stop arrangement 2005 described supra, the resulting plug diameter formed by this forming surface is substantially uniform. Stated differently, as the form roll 11 is forced into the gap between the eccentric roll 24 and the slide roll 19, the slide roll is forced away from the eccentric roll as discussed in connection with FIGS. 3A–3D. When the form roll support bracket 2020 hits the form roll stop bracket 2005, radially inward movement of the form roll 11 is halted. This prevents the override pre-load force of spring 279 (FIG. 5) located on the side of the necking turret from exerting its full load on the necked-in can material between form roll 11 and eccentric roll 24 to advantageously prevent wearing away of interior coating material, grooving of the can material, or possible radially inward leveraging movement of eccentric roll 24 under the high override spring force which would disadvantageously cause large variations in the minimum acceptable plug diameter.

As depicted in FIG. 6, each lower bolt **2009*b*,2009*c* extends through a control spacer 2025 interpositioned in the slot 2013 between the bolt head 2027 and the rearward facing surface of the end plate 2006 which provides a clearance of approximately 0.002" between the spacer and bolt head to properly locate the stop bracket 2005 in an axially fixed location relative to the spindle assembly. The top bolt 2009*a* is not provided with a control spacer 2025 and, in the preferred embodiment, is therefore the sole means for clamping the stop bracket 2005 to the spindle assembly upon tightening engagement. Therefore, loosening of the easily accessible top bolt 2009*a* provides an easy and effective means for rotating the form roll stop bracket 2005 about the spindle rotational axis R to vary the rotational position of any point on the stop surface 2017. Circumferentially spaced, radial bores 2018 in disk 2005 enable insertion of a screw driver or rod-shaped implement to rotate bracket 2005** for adjustment purposes described below.

The semi-cylindrical form roll stop surface 2017, in accordance with another unique feature of this invention, is machined to have a central axis R' which is eccentric with respect to the spindle rotational axis R. In this manner, rotation of the form roll stop bracket 2005 in a counter-clockwise direction A (FIG. 7), for example, results in a progressive reduction in radial location of the stop surface 2017 to decrease the plug diameter, while rotation in the clockwise direction B increases the radial location to cause a corresponding increase in the plug diameter. To allow for controlled adjustment of the radial location of the stop surface 2017, graduated marks 2030 (FIG. 9) are formed at circumferentially spaced intervals along the upper arcuate extent of the flat disk shaped mounting section 2005 while a reference alignment mark (not shown) is formed on a stationarily adjacent portion of the spindle housing end plate 2006.

In the preferred embodiment, the stop surface 2017 is formed such that each of approximately 2° of rotation corresponds to a change in plug diameter of exactly 0.002".

Figure 8:
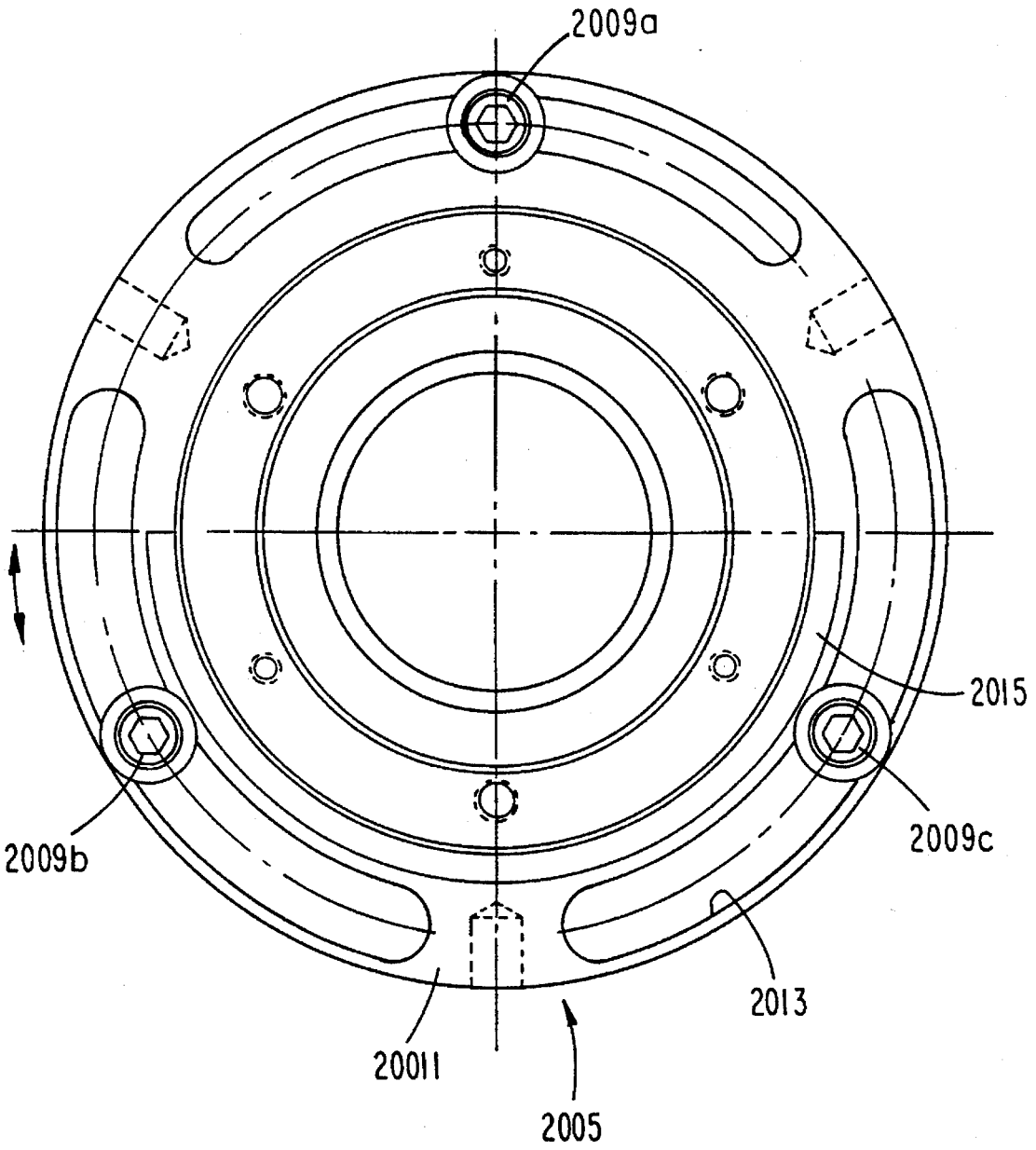
FIG. 8 is another end plan view of the form roll stop bracket of FIG. 6.
Figure 9:
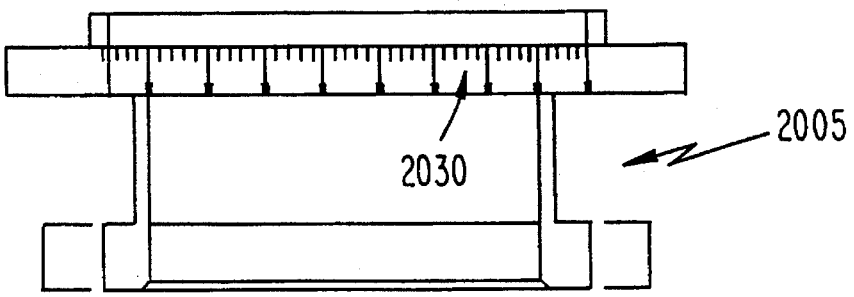
FIG. 9 is an illustration of a top view and an end plan view of the form roll stop bracket with an exemplary scale as used in the preferred embodiment.
Figure 9:
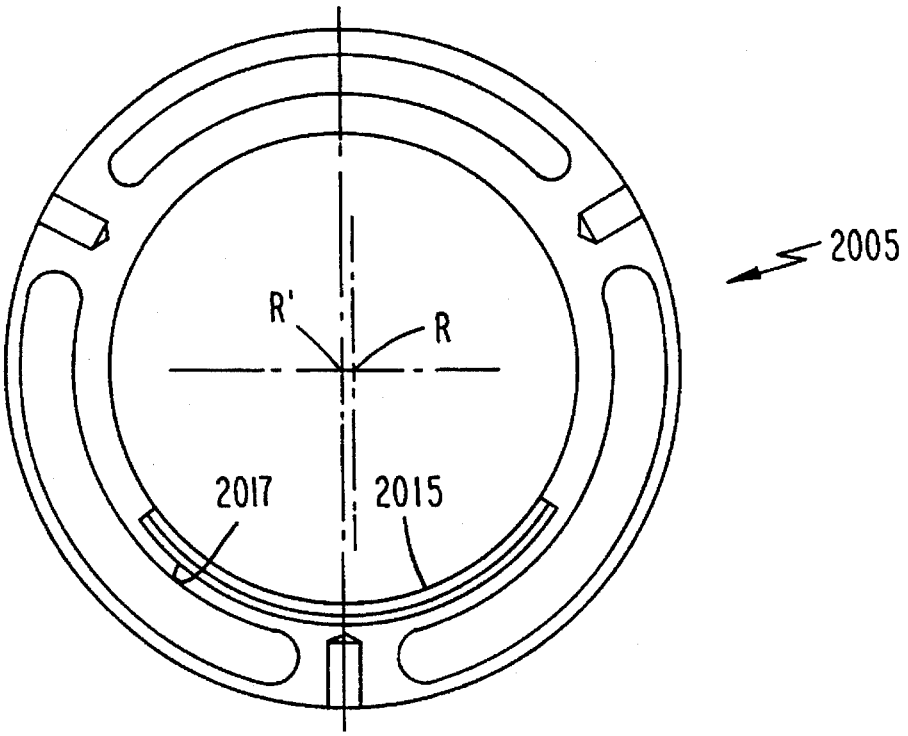

FIG. 9 is an illustration of a top view of the form roll stop bracket 2005 with an exemplary scale 2030 as used in the preferred embodiment. In this embodiment, stop surface 2017 subtends an angular interval of 110°, instead of 180° as depicted in FIG. 8, which is sufficient for most applications. The location of the scale marks corresponds to the degree of angular rotation of the stop bracket in accordance with the following table:

| LOCATION OF SCALE MARKS | | |
|---|---|---|
| ANGLE FROM 0° | | |
| 0 | — | 00.0000° |
| | — | 02.2636° |
| | — | 04.4658° |
| | — | 06.6142° |
| | — | 08.7155° |
| 10 | — | 10.7753° |
| | — | 12.7985° |
| | — | 14.7894° |
| | — | 16.7819° |
| | — | 18.6893° |
| 20 | — | 20.6048° |
| | — | 22.5012° |
| | — | 24.3812° |
| | — | 26.2471° |
| | — | 28.1013° |
| 30 | — | 29.9459° |
| | — | 31.7831° |
| | — | 33.6148° |
| | — | 35.4431° |
| | — | 37.2697° |
| 40 | — | 39.0968° |
| | — | 40.9261° |
| | — | 42.7596° |
| | — | 44.5993° |
| | — | 46.4473° |
| 50 | — | 48.3057° |
| | — | 50.1768° |
| | — | 52.0628° |
| | — | 53.9664° |
| | — | 55.8904° |
| 60 | — | 57.8376° |
| | — | 59.8114° |
| | — | 61.8154° |
| | — | 63.8538° |
| | — | 65.9312° |
| 70 | — | 68.0529° |
| | — | 70.2251° |
| | — | 72.4551° |
| | — | 74.7516° |
| | — | 77.1251° |
| 80 | — | 79.5885° |
| | — | 82.1582° |
| | — | 84.8554° |
| | — | 87.7084° |
| | — | 90.7565° |

The feature of utilizing form roll stop bracket 2005 to define the extent of final radial inward movement of form roll 11, in addition to promoting more uniform plug diameters as between successively necked cans, also acts as a shock absorber to prevent the full spring pre-load force of spring 279 from acting against eccentric roll 24 and the necked-in can material therebetween in a disadvantageous manner as discussed above. Thus, form roll stop 2005, preferably used in combination with cam ring 102 (FIG. 4A), enables reliable control over the degree of forming force exerted by the spring loaded form roll 11 against the can metal in forming contact with the slide and eccentric rolls 19,24.

Figure 4A:
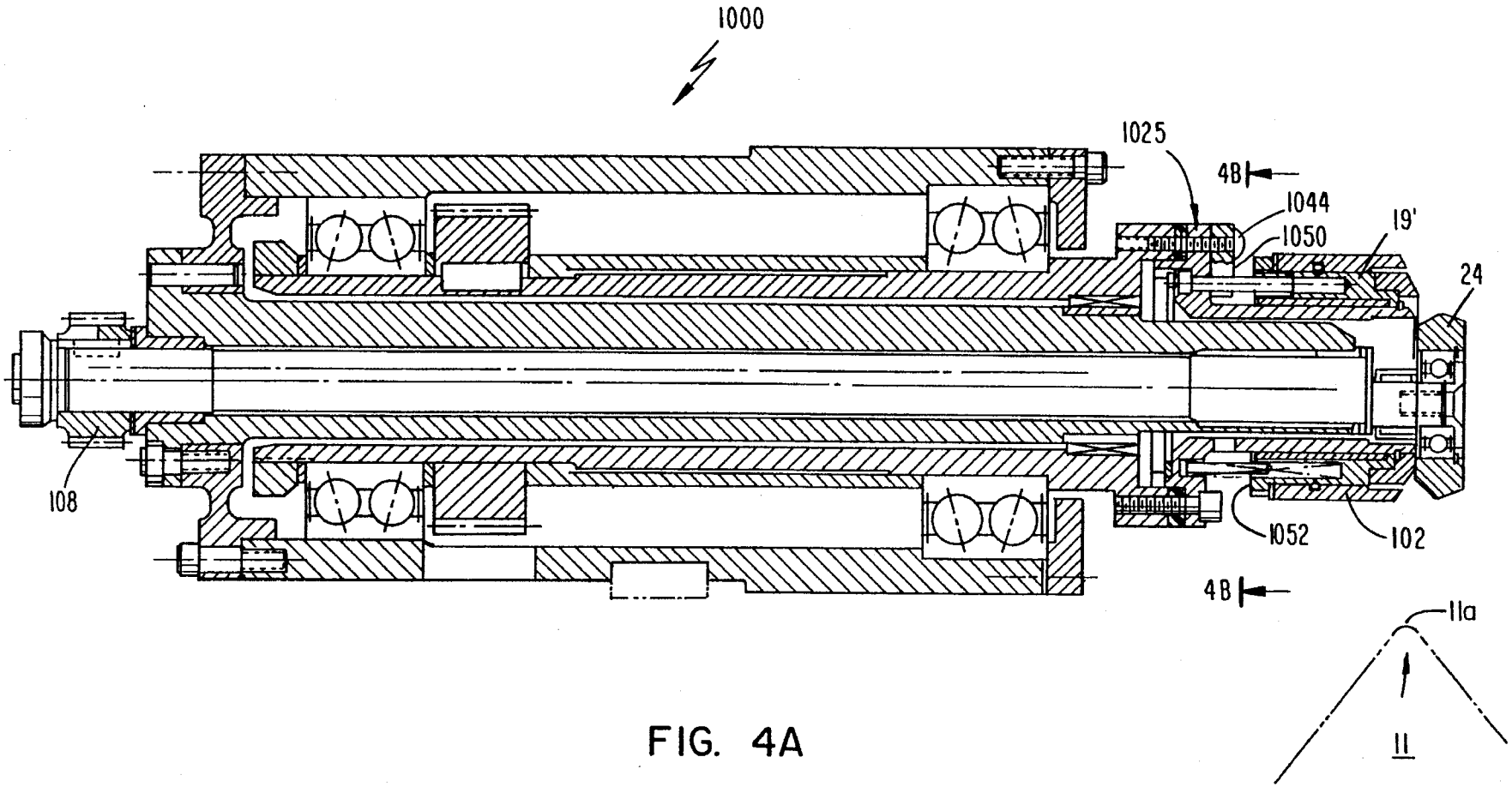
FIGS. 4A and 4B are illustrations of a tooling necking spindle assembly in accordance with an invention disclosed in assignee's co-pending '421 application.
Figure 4B:
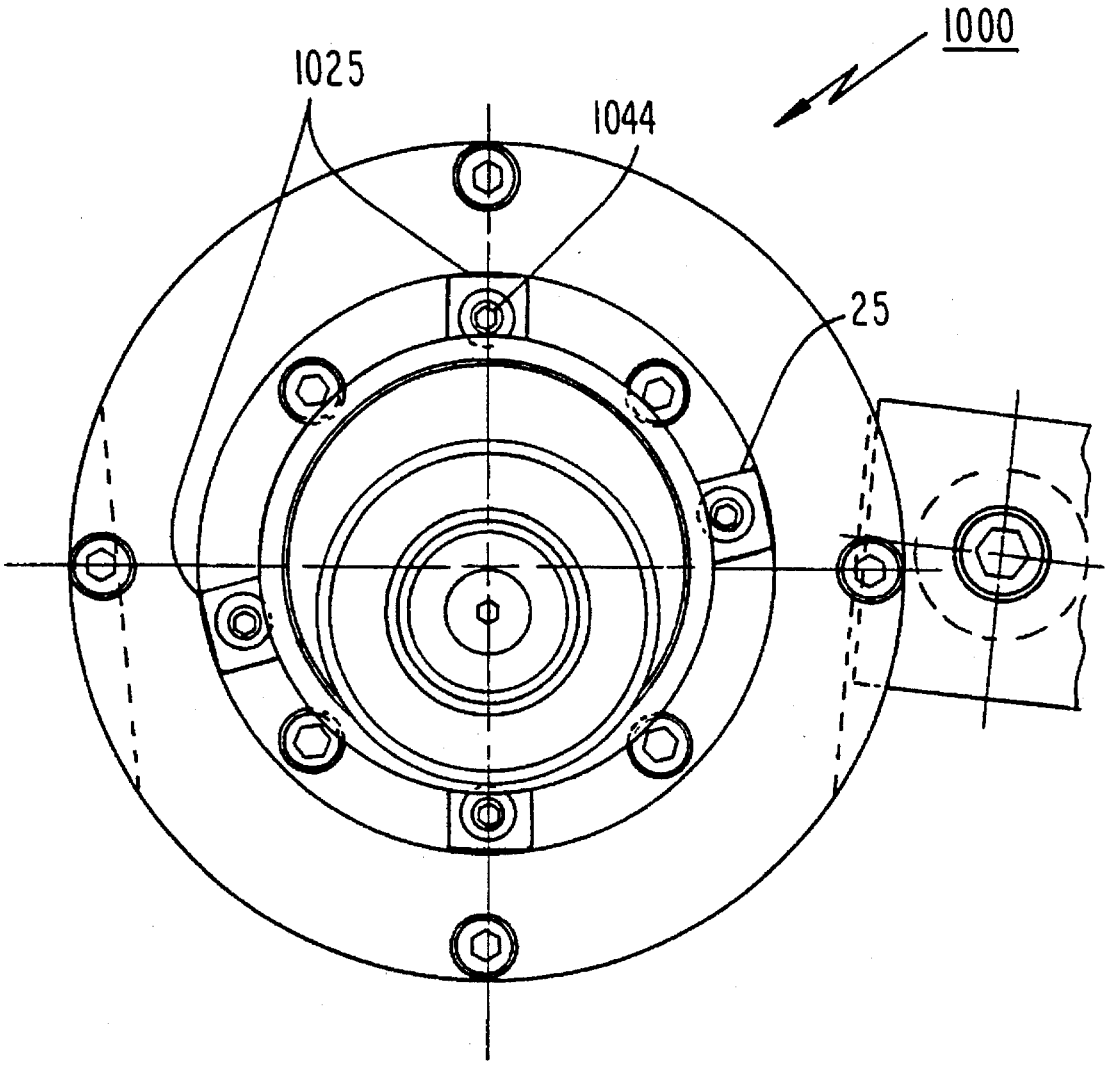
Figure 10:
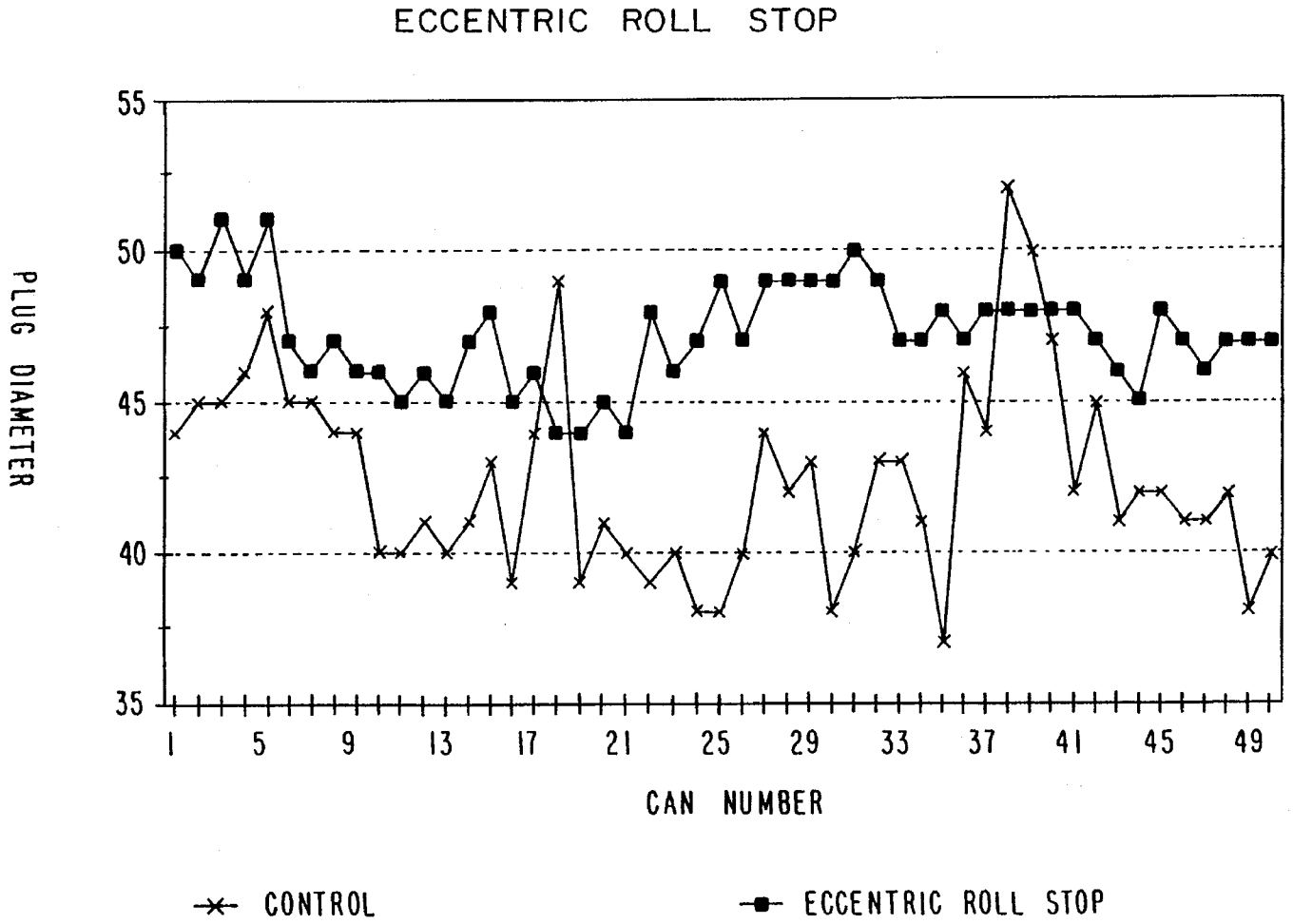
FIG. 10 is a chart depicting the results of testing utilizing the present invention with a control standard.

A single station test stand was set up to control and set the can plug diameter and flange width utilizing the spacer 1050 behind slide roll 19 as depicted in FIG. 4A herein with standard tooling used to produce a 202/211 neck. Fifty cans were run as a control. A single station test stand was then set up with the eccentric roll stop bracket 2005 of the present invention using the same tooling. The following table below and FIG. 10 herein sets forth the results of both tests:

| Control, spacer behind slide roll. | | | | | | Eccentric stop for form roll. | | | | | |
|---|---|---|---|---|---|---|---|---|---|---|---|
| | | FLANGE | | | | | | FLANGE | | | |
| CAN # | PLUG | LOW | HIGH | AVG | RANGE | CAN # | PLUG | LOW | HIGH | AVG | RANGE |
| 1 | 44 | 72 | 81 | 76.5 | 9 | 1 | 50 | 70 | 77 | 73.5 | 7 |
| 2 | 45 | 68 | 75 | 71.5 | 7 | 2 | 49 | 62 | 74 | 68.0 | 12 |
| 3 | 45 | 68 | 74 | 71.0 | 6 | 3 | 51 | 64 | 73 | 68.5 | 9 |
| 4 | 46 | 70 | 81 | 75.5 | 11 | 4 | 49 | 68 | 78 | 73.0 | 10 |
| 5 | 48 | 70 | 79 | 74.5 | 9 | 5 | 51 | 72 | 78 | 75.0 | a |
| 6 | 45 | 72 | 81 | 76.5 | 9 | 6 | 47 | 62 | 71 | 66.5 | 9 |
| 7 | 45 | 75 | 83 | 79.0 | 8 | 7 | 46 | 66 | 74 | 70.0 | 8 |
| 8 | 44 | 70 | 79 | 74.5 | 9 | 8 | 47 | 68 | 77 | 72.5 | 9 |
| 9 | 44 | 69 | 80 | 74.5 | 11 | 9 | 46 | 65 | 75 | 70.0 | 10 |
| 10 | 40 | 61 | 78 | 69.5 | 17 | 10 | 46 | 67 | 75 | 71.0 | 8 |
| 11 | 40 | 70 | 80 | 75.0 | 10 | 11 | 45 | 64 | 75 | 69.5 | 11 |
| 12 | 41 | 65 | 75 | 70.0 | 10 | 12 | 46 | 66 | 74 | 70.0 | 8 |
| 13 | 40 | 65 | 77 | 71.0 | 12 | 13 | 45 | 65 | 75 | 70.0 | 10 |
| 14 | 41 | 70 | 77 | 73.5 | 7 | 14 | 47 | 65 | 71 | 68.0 | 6 |
| 15 | 43 | 63 | 71 | 67.0 | 8 | 15 | 48 | 72 | 80 | 76.0 | 8 |
| 16 | 39 | 65 | 77 | 71.0 | 12 | 16 | 45 | 70 | 77 | 73.5 | 7 |
| 17 | 44 | 63 | 70 | 66.5 | 7 | 17 | 46 | 70 | 80 | 75.0 | 10 |
| 18 | 49 | 64 | 76 | 70.0 | 12 | 18 | 44 | 70 | 78 | 74.0 | 8 |
| 19 | 39 | 68 | 74 | 71.0 | 6 | 19 | 44 | 65 | 75 | 70.0 | 10 |
| 20 | 41 | 69 | 75 | 72.0 | 6 | 20 | 45 | 67 | 75 | 71.0 | 8 |
| 21 | 40 | 67 | 75 | 71.0 | 8 | 21 | 44 | 63 | 75 | 69.0 | 12 |
| 22 | 39 | 72 | 78 | 75.0 | 6 | 48 | 67 | 77 | 72.0 | 10 | |
| 23 | 40 | 58 | 71 | 63.5 | 15 | 23 | 46 | 67 | 80 | 73.5 | 13 |
| 24 | 38 | 64 | 80 | 72.0 | 16 | 24 | 47 | 70 | 79 | 74.5 | 9 |
| 25 | 38 | 65 | 72 | 68.5 | 7 | 25 | 49 | 70 | 74 | 72.0 | 4 |
| 26 | 40 | 65 | 75 | 70.0 | 10 | 26 | 47 | 69 | 76 | 72.5 | 7 |
| 27 | 44 | 63 | 75 | 69.0 | 12 | 27 | 49 | 75 | 81 | 78.0 | 6 |
| 28 | 42 | 68 | 75 | 71.5 | 7 | 28 | 49 | 63 | 71 | 67.0 | 8 |
| 29 | 43 | 68 | 75 | 71.5 | 7 | 29 | 49 | 65 | 78 | 71.5 | 13 |
| 30 | 38 | 65 | 79 | 72.0 | 14 | 30 | 49 | 67 | 78 | 72.5 | 11 |
| 31 | 40 | 66 | 76 | 71.0 | 10 | 31 | 50 | 71 | 78 | 74.5 | 7 |
| 32 | 43 | 61 | 72 | 66.5 | 11 | 32 | 49 | 64 | 72 | 68.0 | 8 |
| 33 | 43 | 68 | 77 | 72.5 | 9 | 33 | 47 | 68 | 80 | 74.0 | 12 |
| 34 | 41 | 67 | 75 | 71.0 | 8 | 34 | 47 | 66 | 78 | 72.0 | 12 |
| 35 | 37 | 69 | 75 | 72.0 | 6 | 35 | 48 | 62 | 73 | 67.5 | 11 |
| 36 | 46 | 70 | 80 | 75.0 | 10 | 36 | 47 | 70 | 80 | 75.0 | 10 |
| 37 | 44 | 71 | 76 | 73.5 | 5 | 37 | 48 | 68 | 77 | 72.5 | 9 |
| 38 | 52 | 72 | 81 | 76.5 | 9 | 38 | 48 | 67 | 80 | 73.5 | 13 |
| 39 | so | 69 | 82 | 75.5 | 13 | 39 | 48 | 66 | 75 | 70.5 | 9 |
| 40 | 47 | 72 | 78 | 75.0 | 6 | 40 | 48 | 65 | 75 | 70.0 | 10 |
| 41 | 42 | 72 | 77 | 74.5 | 5 | 41 | 48 | 65 | so | 72.5 | 15 |
| 42 | 45 | 64 | 74 | 69.0 | 10 | 42 | 47 | 70 | 76 | 73.0 | 6 |
| 43 | 41 | 58 | 74 | 66.0 | 16 | 43 | 46 | 70 | 76 | 73.0 | 6 |
| 44 | 42 | 62 | 73 | 67.5 | 11 | 44 | 45 | 70 | 79 | 74.5 | 9 |
| 45 | 42 | 72 | 83 | 77.5 | 11 | 45 | 48 | 65 | 75 | 70.0 | 10 |
| 46 | 41 | 62 | 77 | 69.5 | 15 | 46 | 47 | 66 | 76 | 71.0 | 10 |
| 47 | 41 | 69 | 76 | 72.5 | 7 | 47 | 46 | 68 | 77 | 72.5 | 9 |
| 48 | 42 | 60 | 71 | 65.5 | 11 | 48 | 47 | 62 | 76 | 69.0 | 14 |
| 49 | 38 | 65 | 78 | 71.5 | 13 | 49 | 47 | 65 | 77 | 71.0 | 12 |
| 50 | 40 | 70 | 78 | 74.0 | 8 | 50 | 47 | 72 | 78 | 75.0 | 6 |
| AVG | 42.44 | 66.98 | 76.62 | 71.8 | 9.64 | AVG | 47.24 | 67.08 | 76.38 | 71.73 | 9.3 |
| S.DEV. | 3.238 | 4.052 | 3.193 | 3.321 | 3.018 | S.DEV. | 1.692 | 3.012 | 2.537 | 2.526 | 2.343 |
| MAX | 52 | 75 | 83 | 79 | 17 | MAX | 51 | 75 | 81 | 78 | 15 |
| MIN | 37 | 56 | 70 | 63.5 | 5 | MIN | 44 | 62 | 71 | 66.5 | 4 |
| RANGE | 15 | 19 | 13 | 15.5 | 12 | RANGE | 7 | 13 | 10 | 11.5 | 11 |

From the foregoing table, it can be seen that the range for the plug diameter was reduced over half, i.e., from 0.015" with the slide roll spacer as a control down to 0.007" with the eccentric roll stop bracket 2005 of the invention. It is to be further noted that the variation was reduced at the small plug diameter (min), not the large diameter (max). It is theorized that the reduction in variation at the small plug diameter occurs since the eccentric roll stop 2005 eliminates the heavy die spring load of approximately 230 pounds between the form roll 11 and the eccentric roll 24. As mentioned above, this load is applied when the slide roll 19 bottoms out against the spacer 1050 in FIG. 4A and the bolt on the connection rod then lifts off (FIG. 5). The eccentric roll 24 is mounted on a cantilevered shaft which can then bend down as noted above, producing a smaller plug diameter when the heavy forming load is applied. The present invention minimizes such bending of the cantilevered shaft also as noted above.

The feature of controlling the degree of spring force acting through form roll 11 against both the slide roll 19 and eccentric roll 24 and the necked-in can material therebetween, now creates the potential for further reduction of metal in the formation of the can body. For example, in a metal can manufactured with a D&I process, the average metal thickness in the mid-portion of the can side wall between the can bottom and open end is approximately 0.0043" with the thickness increasing in the necked-in region to approximately 0.0067", with the thicker metal in the open end necessary to enable the can to withstand the necking-in forces. In the D&I process, in order to avoid tear-offs, the ironing reduction between the mid-die and the end die must not exceed 46%. Therefore, in a spin flow necking process which does not utilize form roll stop bracket 2005 to control the spring pre-load, an average metal wall thickness in the neck region of approximately 0.067" is necessary to ensure reliable necking-in. This in turn requires the average side wall thickness in the mid-portion of the can to be approximately 0.0043" to satisfy the aforesaid ironing reduction ratio. However, with form roll stop bracket 2005 of the present invention, the can open end can now be manufactured with an average thickness of, for example, 0.061" since the form roll spring pre-load force is now being controlled in the advantageous manner noted above. Consequently, and advantageously, the average side wall thickness in the mid-portion of the can may now be reduced to about 0.037" for increased metal savings in the manufacture of metal cans with this process and apparatus.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. Apparatus for necking-in an open end of a side wall of a container body, comprising:

a) a first member and a second member mounted for engaging inside surfaces of the container side wall defining said open end;

b) an arrangement for rotating said container body;

c) an externally located member mounted for radially inward movement into deforming contact with an outside surface of said container side wall in a region thereof overlying an interface between said first and second members, whereby contact between said externally located member with said side wall causes the contacted wall portion to move radially inwardly into a gap formed at the interface caused by axial separation of said first and second members under the action of the radially inward advancing movement of the externally located member into the gap to thereby neck-in said side wall; and d) stop means for limiting radial inward movement of said externally located member.

2. Apparatus of claim 1, further comprising means, controlled by sensing radially inward movement of the externally located member, for initiating gradual axial separation of said first and second members before said externally located means acts directly on both said first and second members through the contacted portion.

3. Apparatus of claim 2, wherein said first member is a slide roll engaging the inside of the container side wall open end and mounted for driven rotary motion about, and axial movement along, the container axis, and including resilient means for biasing said slide roll into the container open end;

said second member is an axially fixed second roll mounted in axially inwardly spaced relation to the slide roll for engagement with an inside surface of the container side wall, said second roll having a conical end surface which faces the open end of the container and said slide roll including a conical end surface facing the conical end surface of the second roll, said conical surfaces extending in opposite inclinations to each other;

said externally located member is a form roll having a peripheral deforming nose positioned externally of the container side wall and mounted for free rotary and controlled radial movement towards and away from the side wall, said form roll being biased for axial movement along an axis parallel to the container axis, said form roll deforming nose including first and second oppositely inclined conical surfaces which are respectively opposed to the conical surface on the second roll and the conical surface on the slide roll.

4. Apparatus of claim 3, further comprising a necking spindle for supporting said slide roll and second roll, and wherein said stop means includes a form roll stop bracket connected to the necking spindle and including a radially fixed stop surface contactable with another stop surface on a bracket supporting said form roll.

5. Apparatus of claim 1, further comprising means, controlled by sensing radially inward movement of the externally located member, for initiating gradual axial separation of said first and second members before said externally located member acts directly on both said first and second members through the contacted portion, wherein said stop means includes a form roll stop bracket connected to first and second member supporting structure and having a stop surface contactable with a stop surface on a form roll supporting bracket to limit radially inward movement of said externally located member.

6. A method of spin flow necking-in an open end of a cylindrical container body, comprising the steps of:

a) positioning inside the container body, in axial inwardly spaced relation from the open end thereof, an axially fixed roll engageable with an inside surface of the container body, said axially fixed roll having a sloped end surface which faces the open end;

b) positioning inside the container body a slide roll which fits the inside diameter of the container body to support the same, said slide roll having an end facing the sloped end surface of said axially fixed roll, and said slide roll being supported for axial displacement away from said axially fixed roll, said slide roll end and said sloped end surface of said axially fixed roll defining a gap therebetween;

c) positioning opposite said gap on an outside surface of the container body a form roll supported for axial displacement away from said axially fixed roll, said form roll having a trailing end portion and a peripheral portion;

d) spinning the container body thusly supported by said slide roll and advancing said form roll radially inwardly relative to said gap so that said trailing end portion presented by the form roll and said sloped end surface of said axially fixed roll engage the container body between them while said trailing end portion of said form roll moves radially inward along said sloped end surface of said axially fixed roll to roll a neck into the container body; and e) continuing to spin the container body while the form roll moves inwardly and the slide roll retracts axially until the form roll has spun an outwardly extending portion on the end portion of the container body engaged between said slide roll and said form roll; and f) stopping the radially inward movement of the form roll in step (e) by first preventing further radially inward movement of said form roll at a predetermined location.

7. The method of claim 6, wherein the axial retracting movement of the slide roll is controlled by contact between a surface of the form roll with a cam follower surface connected to the slide roll for controlling such axial retraction of said slide roll.

8. The method of claim 6, wherein said form roll, at the time its radially inward advancing movement is stopped under step (f), is under a predetermined spring load force, a part of which is now absorbed by the mechanism stopping the radial inward movement of said form roll so that said part no longer acts upon the said axially fixed roll.

9. Apparatus for necking-in an open end of a side wall of a container body, comprising:

a) a necking spindle assembly for rotating said container body;

b) a slide roll and an eccentric roll mounted on said necking spindle assembly for engaging inside surfaces of the container side wall defining said open end;

c) a form roll mounted for radially inward movement into deforming contact with an outside surface of said container side wall in a region of the open end overlying an interface between said slide and eccentric rolls, whereby contact between said form roll with said side wall causes the contacted surface of said container side wall to move by radially inward deformation into a gap formed at the interface caused by axial separation of said slide and eccentric rolls under the action of the radially inward advancing movement of the form roll into the gap to thereby neck-in said side wall; and d) at least one stop member mounted to the necking spindle assembly and including a radially fixed stop surface contactable with a radially inwardly advancing form roll support bracket to thereby stop the radially inward advancing movement of the form roll.

10. Apparatus of claim 9, further comprising a cam ring connected to the slide roll and including a cam follower surface which is contacted by the form roll during radially inward movement of the form roll to initiate gradual said axial separation between said slide and eccentric rolls before said form roll acts directly on both said slide and eccentric rolls through said contacted surface, said axial separation occurring as a result of form roll induced movement of said cam ring transmitted to impart rearward axial retraction of the slide roll.

11. Apparatus of claim 10, wherein said slide roll engages the inside of the container side wall open end and is mounted for driven rotary motion about, and axial movement along, the container axis, and including a spring for biasing said slide roll into the container open end;

said eccentric roll is axially fixed and mounted in axially forwardly spaced relation to the slide roll for engagement with an inside surface of the container side wall, said eccentric roll having a conical surface which faces the open end of the container and said slide roll including a conical surface facing the conical surface of the eccentric roll, said conical surfaces extending in opposite inclinations to each other;

said form roll having a peripheral deforming nose positioned externally of the container side wall and mounted for free rotary and controlled radial movement towards and away from the side wall, said form roll being biased for axial movement along an axis parallel to the container axis, said form roll deforming nose including first and second oppositely inclined conical surfaces which are respectively opposed to the conical surface on the eccentric roll and the conical surface on the slide roll.

12. Apparatus of claim 11, wherein said form roll stop bracket is relatively rotatable with respect to the necking spindle to which it is attached by loosening of at least one mounting bolt.

13. Apparatus of claim 12, wherein said stop surface is machined such that its radial location varies as a function of rotational movement of said stop bracket to thereby enable easy adjustment of said plug diameter.

* * * * *